US005700335A

United States Patent [19]

Phillip

[11] Patent Number: 5,700,335

[45] Date of Patent: Dec. 23, 1997

[54] PROCESS AND DEVICE FOR REGULATING THE CALORIFIC OUTPUT IN A CONTINUOUS ANNEALING AND PROCESSING LINE FOR CONTINUOUSLY CAST METAL PRODUCTS

[75] Inventor: Günther Phillip, Erlangen, Germany

[73] Assignee: Maschinenfabrik Niehoff GmbH & Co. KG, Schwabach, Germany

[21] Appl. No.: 387,799

[22] PCT Filed: Aug. 19, 1993

[86] PCT No.: PCT/EP93/02222

§ 371 Date: Apr. 5, 1995

§ 102(e) Date: Apr. 5, 1995

[87] PCT Pub. No.: WO94/04708

PCT Pub. Date: Mar. 3, 1994

[30] Foreign Application Priority Data

Aug. 21, 1992 [DE] Germany ..... 42 27 812.0

[51] Int. Cl.[6] ..... C21D 9/62

[52] U.S. Cl. ..... 148/508; 148/511; 148/566; 148/576; 266/90; 266/92; 266/104; 219/155

[58] Field of Search ..... 148/508, 511, 148/566, 576, 595, 600, 684, 90; 266/78, 79, 80, 92, 102, 103, 104; 374/183; 219/50, 108, 116, 155

[56] References Cited

U.S. PATENT DOCUMENTS 3,842,239 10/1974 Ellinghausen et al. ..... 219/155

FOREIGN PATENT DOCUMENTS 1265183 4/1968 Germany .
1266335 4/1968 Germany .
4010309 5/1991 Germany .
1290718 11/1989 Japan .

OTHER PUBLICATIONS

"Elektrische Ausrüstungen für Widerstands–Drahtglühanlagen", N. Bardahl, Draht, vol. 20, No. 6, 1969, Bamberg, Germany, pp. 390–395.

*Primary Examiner*—Sikyin Ip
*Attorney, Agent, or Firm*—Pearne, Gordon, McCoy & Granger LLP

[57] ABSTRACT

A process and device are disclosed for regulating the annealing power in at least one annealing section of a continuous annealing and processing line for continuously cast metal products. The speed of the cast products (D) passing through the continuous annealing device is detected, as well as the voltage currently applied to the annealing section, which is converted into an effective value ($U_e$) by means of a control device (50). The voltage supplied to the annealing section is modified by a control signal derived from the determined effective value of the voltage, in order to achieve a predetermined annealing power value dependent on the measured speed. At least the current flowing in one annealing section is also detected and converted into an effective value. The annealing power actually supplied to the annealing section is calculated from said effective values. The voltage value is modified by a control device until a predetermined value of the annealing power is reached.

22 Claims, 5 Drawing Sheets

PROCESS AND DEVICE FOR REGULATING THE CALORIFIC OUTPUT IN A CONTINUOUS ANNEALING AND PROCESSING LINE FOR CONTINUOUSLY CAST METAL PRODUCTS

BACKGROUND OF THE INVENTION

The present invention relates to a process and a device regulating the calorific output in a resistance annealing plant.

Description of Related Art

A continuous resistance annealing and processing line is used for subjecting continuously cast metal products to heat treatment, the term "continuously cast metal products" here denoting wire made of ferrous and nonferrous metals, in particular copper, but also bundles of parallel, twisted or stranded wires made of these materials. To simplify matters, the term "wire" is used for characterizing these products in this document.

In a continous annealing and processing line the wire is led over at least two contact elements having a different voltage potential, such that a current runs through the wire resulting in its heating. Preferably rotating rollers are used as contact elements, having a circumferential speed principally equal to the passing speed of the wire; however, electrolytes and molten metal baths as well as fixed contact elements may be used. The problems of regulating the calorific power in such a continous annealing and processing plant and the solution as provided for by this invention are detailed in the example of a three-phase current annealing plant for thin copper wires. However, using this example shall in no way be understood as a limitation of the applicability of the present invention to resistance annealing plants in general, rather may the invention also be used for other continous annealing and processing plants, such as DC annealing plants.

As is generally known, flexible electric lines normally have copper strands, manufactured of individual wires having a diameter of e.g. 0.2 mm. In case one or several of these individual wires of the strand break during use, not only the electric conductivity is impaired, but in particular the danger arises that individual wires penetrate the electric insulation, resulting in a considerable danger of accidents.

Therefore the mechanical quality of such strands, in particular the fatigue strength under reversed bending stresses has to meet high requirements which have been laid down by VDE (Association of German Electrical Engineers) in the Federal Republic of Germany.

If the copper wire used for manufacturing brands is drawn to its final diameter in a wire drawing machine, the metal structure changes and the wire becomes hard and brittle and has only a low fatigue strength under reversed bending stresses. In order to give the wire the desired mechanical properties, it is subsequently subjected to a heat treatment in a continous annealing and processing plant. To guarantee the desired quality, the achieved annealing temperature of the wire has to be within a strictly defined temperature range, and if the temperature falls below this range or exceeds it, this results in a quality impairment and—as a consequence—in refuse.

In order to assure that the desired temperature range is reached, it would be advantageous, if the temperature of the passing wire could be measured exactly. However, this meets with difficulties as—on the one hand—the wire runs through the wire annealing plant at high speed (e.g. 10–30 m/s) and—on the other hand—the wire surface is very small due to the small diameter, such that here the prior art methods for measuring the surface temperature will not be successful.

As described in DE 40 10 309 C1 the regulation of such continous annealing and processing plants is therefore performed via regulating the calorific power according to the equation $$U_e = G \cdot \sqrt{v}, \qquad \text{(F1)}$$

$U_e$ being the effective value of the heating voltage, v being the speed at which the wire passes through the continous annealing and processing plant and G being the so-called annealing factor, a product- and plant-specific value. Normally the output regulation is performed by means of thyristors in antiparallel connection, whose firing angle is controlled adequately.

Although this prior art regulation process and this prior art regulation device works satisfactorily in many applications it turned out that a further quality increase in the ultimate product is not possible, in particular when annealing thin wires. In order to reach such a quality increase it is necessary to heat the wire in the annealing plant in accordance with an accurately predetermined temperature profile, i.e. in particular the deviations of the achieved maximum temperature from the desired rated value shall only be small. For achieving a constant quality level it is also important that this temperature profile will be reached during the overall operating period of the relevant contact elements, i.e. the contact rollers.

Therefore the present invention is based upon the task to creat an improved procedure and an improved device for regulating the calorific output in a continous annealing and processing plant for continously cast metal products, achieving an exactly reproduceable temperature march, mostly independent of outside influences such as wear of contact rollers or brushes.

As provided for by this invention this task is solved by a process disclosed herein.

The device as provided for by this invention is also disclosed herein.

The process as provided for by this invention offers the possibility to measure the annealing power supplied to the wire very exactly and independently of possible surface wear on the contact elements or rollers. As is state of the art, the process as provided for by this invention measures the wire speed, thus giving the amount of wire passing through the annealing plant per time unit. An accordingly programmed control device calculates from the wire speed which annealing output has to be supplied to the wire for reaching the desired wire temperature. In case the annealing plant includes several individual annealing sections, there might be a separate allowance of the annealing output for each individual annealing section. Then the annealing output serves to derive a rated value for setting the effective value of the annealing voltage by means of the phase control. Consequently a planned status is given which may, however, differ considerably from the actual state, e.g. in dependence on the transition resistances between the brushes and the rotating contact rollers, on the transition resistances between the contact rollers or the contact elements and the wire and so on.

In order to minimize these deviations, the annealing voltage supplied to the contact elements will be measured and digitized in an analog to digital converter. In addition the current in the wire will be measured. This value will also be digitized. The digitized values of current and voltage will serve to calculate the effective values and the overall annealing output supplied to the wire and compared with the actual value. In case of deviations of the actual value, the voltage regulation will be changed accordingly.

The process as provided for by this invention includes considerable advantages as compared to prior art processes. In conventional processes the effective value of the annealing voltage is created by squaring the voltage signal in an electronic component. However, this value includes an error having more or less decisive effects, as the effective value composer forms an exactly correct value only for a certain curve, e.g. only for a sinusoidal course. By digitizing the values and calculating the effective value from the digitized values, the control accuracy will be considerably improved.

In addition the measurement of the current in the passing wire permits a further accuracy increase of the annealing power regulation. The overall voltage on the contact elements is only the voltage on the individual wire section, if there are no transition resistances between the voltage supply line to the contact element and the wire itself. For example, a transition resistance between a brush and a rotating contact roller and/or between the contact roller and the wire due to wear or contamination, results in an overall resistance increase and thus in a decrease of the current flowing through the wire. In a conventional plant the transition resistances consequently reduce the temperature achieved, without having the possibility to grasp it by means of the regulation.

Measuring the voltage and the current flowing through the wire also permit the detection of wear on the contact elements. If the current flowing through the wire decreases during operation although the same effective voltage is applied, this normally indicates an increase in transition resistances and this usually means wear. The optimum time for replacing or reworking the contact elements may thus be determined by checking the transition resistances.

The arrangement for regulating the annealing output as provided for by this invention includes units to detect the relevant instantaneous value of the voltage and current on the annealing section. The voltage is measured in the conventional way. The current may be measured in the supply lines, however—in particular when using an annealing plant with several annealing sections arranged consecutively—the use of a current meter capable of measuring the current flowing directly in the wire, is preferred. As provide for in this invention a slotted iron ring is used for measuring this current, the wire runs through it without touching it and a Hall probe measures the magnetic flux induced by the current flowing through the wire.

The detection of the current flowing through the wire has the advantage that thus the influence of leak currents will be eliminated. Such leak currents appear e.g. in case of contact roller or electrolyte contamination.

In case an annealing plant with several annealing sections is used, i.e. a three-phase current annealing plant, the current measurement may be performed in each annealing section. If the amount of equipment is to be reduced, it is also possible to measure the current only in the last or in the first and the last annealing section.

BRIEF DESCRIPTION OF THE DRAWINGS

Further advantages, features and application possibilities of the present invention result from the subsequent description of the embodiment examples and the relevant figures.

DETAILED DESCRIPTION OF THE PREFERRED EMBODIMENTS

Figure 1:
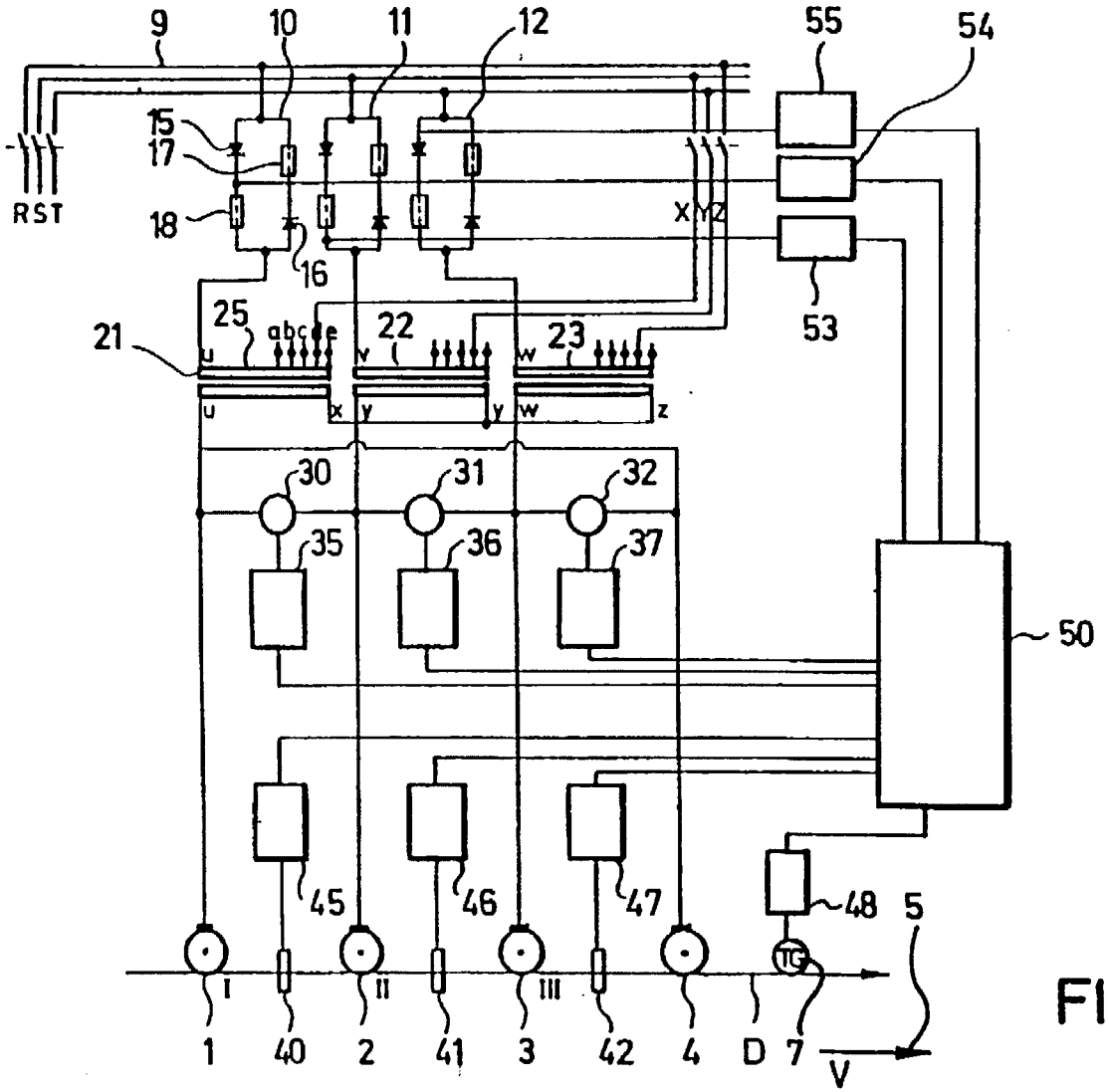
FIG. 1 shows a functional diagram of an embodiment example of the arrangement as provided for in this invention.

The embodiment example according to FIG. 1 shows the application of the present invention in a three-phase current annealing arrangement, with a copper wire having a diameter of 0.63 mm running through it. The wire speed is +10 m/s.

The three-phase current annealing plant includes four contact rollers 1, 2, 3, and 4, shown on one level in the diagram according to FIG. 1. Wire D moves at speed v in the direction of arrow 5 through the wire annealing arrangement, the speed is measured by a tachometer generator 7.

The contact rollers 1 to 4 will be supplied by a three-phase network 9, having three phases R, S, T, which are arranged out-of-phase by 120°, as is state of the art. The phases of the three-phase current are connected to three AC power controllers 10, 11, 12, each consisting of two thyristors 15, 16 in antiparallel connection and of two resistors 17, 18.

The AC power controllers 10, 11, 12 each are connected with the primary of one of the three transformers 21, 22 and 23, which are connected in a triangle with regard to the primary. With regard to the secondary the three transformers 21, 22, 23 form an y-delta connection. The exit of transformer 21 leads to contact roller 1 and 4, the exit of transformer 23 to contact roller 2 and the exit of transformer 21 to contact roller 3. As contact roller 1 and contact roller 4 have the same voltage potential, the annealing arrangement as a whole is electrically neutral.

The annealing voltages $U_1$, $U_2$, $U_3$ on the annealing sections I, II, III will be measured by the measuring units 30, 31, 32 and transformed to a digital voltage value in the transformer units 35, 36, 37. Each transformer unit 35, 36, 37 includes an insulating amplifier, topped by a low-pass filter with a 1000 Hz cut-off. The filter's output signal is led to a analog-to-digital transformer and digitized. The scanning is performed at intervals of 500 82 s, the resolution is 12 Bit.

Figure 7:
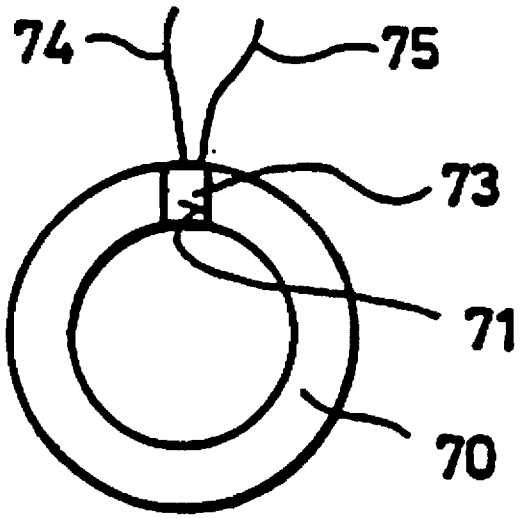
FIG. 7 shows a perspective view of a transducer for measuring the current.

The current flowing through the wire in the annealing sections I, II, III is measured by the sensors 40, 41 and the sensor still will be detailed with respect to FIG. 7. The variable measured will be digitized in the transformer units 45, 46, 47. Similar to the transformer units 35, 36, 37 for the voltage values, the transformer units 45, 46, 47 for the current values consist of a low-pass filter with a 1000 Hz cutoff frequency, topped by an analog-to-digital converter. Scanning rate and resolution are identical with those of the transformer units 35 to 37.

Even the output voltage of the tachometer generator will be digitized in a transformer unit 48.

The digitized values will be passed on to a processor 50, preferably a microprocessor, where the effective values for voltage and current are gained from the digitized values and the effective annealing output in the individual annealing sections will be determined, as will be detailed below.

For controlling the AC power controller the processor emits 50 control signals; in the signal generating units 53, 54, 55 they will be transformed into control signals suitable for driving the AC power controller.

The sensors 40, 41 and 42 for measuring the current in the annealing sections consist of an iron ring 70, as shown in FIG. 7, interrupted by a gap 71. A Hall probe 73 with supply lines 74, 75 is glued into the gap 71.

The current flowing in the annealing sections induces a magnetic flux in the iron ring 70, measured by the Hall probe 73 in the gap 71. The Hall voltage on the supply lines 74, 75 may be immediately converted into the current flowing through the annealing section.

Using such a measurement system for measuring the current in a wire annealing arrangement has particular advantages. On the one hand a contactless measurement is performed, subjecting neither the wire nor the sensing element to any kind of wear. In addition the measurement system is mostly insensitive to contaminations. As the Hall probe virtually works without inertia, the current may be taken very precisely and with an exact course of time.

In principle the sensing element depicted in FIG. 7 is designed as one piece, i.e. the wire has to be threaded through the opening in ring 70. A divisible ring may also be used instead, into which the wire only has to be inserted.

Instead of a divided ring, the Hall probe itself may be designed in such a way that it can be taken out, such that the wire may be laid into the ring through the gap provided for the Hall probe.

The function of this arrangement is now explained with relation to FIGS. 2 to 6.

Figure 2:
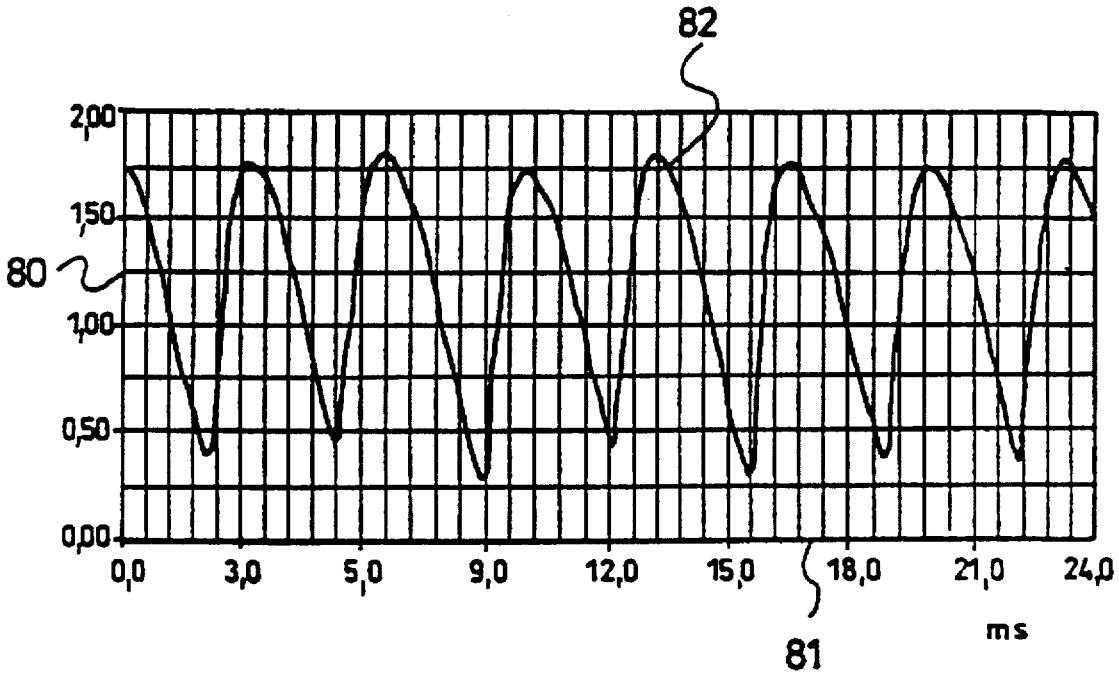
FIG. 2 shows a non-dimensional representation of the course of the annealing voltage during a test.

FIG. 2 gives a non-dimensional representation of the course of time of the annealing voltage during a time period of 25 ms, the wire passing speed being 10 m/s. As mentioned before and also valid for the other figures the wire diameter was 0.63 mm. This measuring result and those of the other figures relates to the last annealing section III.

A non-dimensional voltage parameter is entered on the ordinate 80 and the time on the abscissa 81. The course of the annealing voltage is referred to as 82.

As can be seen from FIG. 2, the voltage course deviates significantly from a sinusoidal course. Forming an effective value based upon a mathematically exact sinusoidal course therefore leads to major errors in case of such voltage courses.

Figure 3:
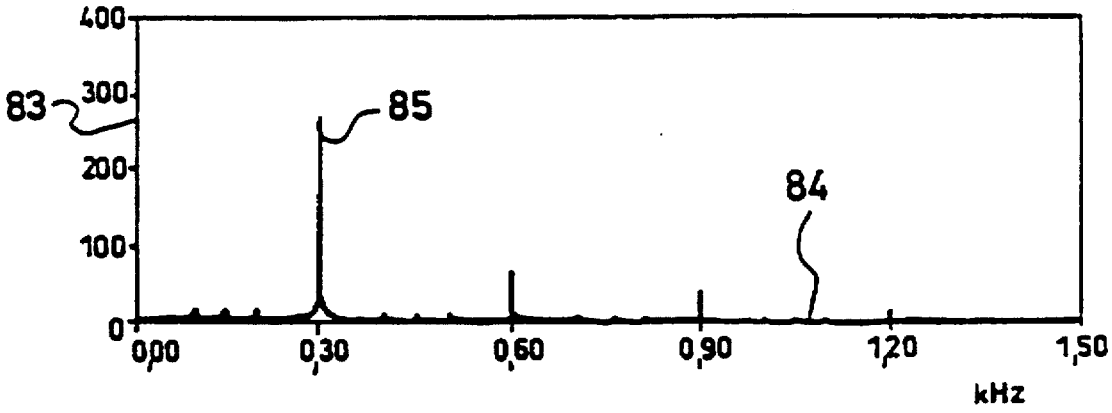
FIG. 3 shows the amplitude range of the curve in accordance with FIG. 2.

FIG. 3 reflects the amplitude range of the annealing voltage curve according to FIG. 2.

A non-dimensional amplitude parameter is entered on ordinate 83 and the frequency in kHz on the abscissa 84.

The amplitude course with respect to time is referred to as 85.

Figure 4:
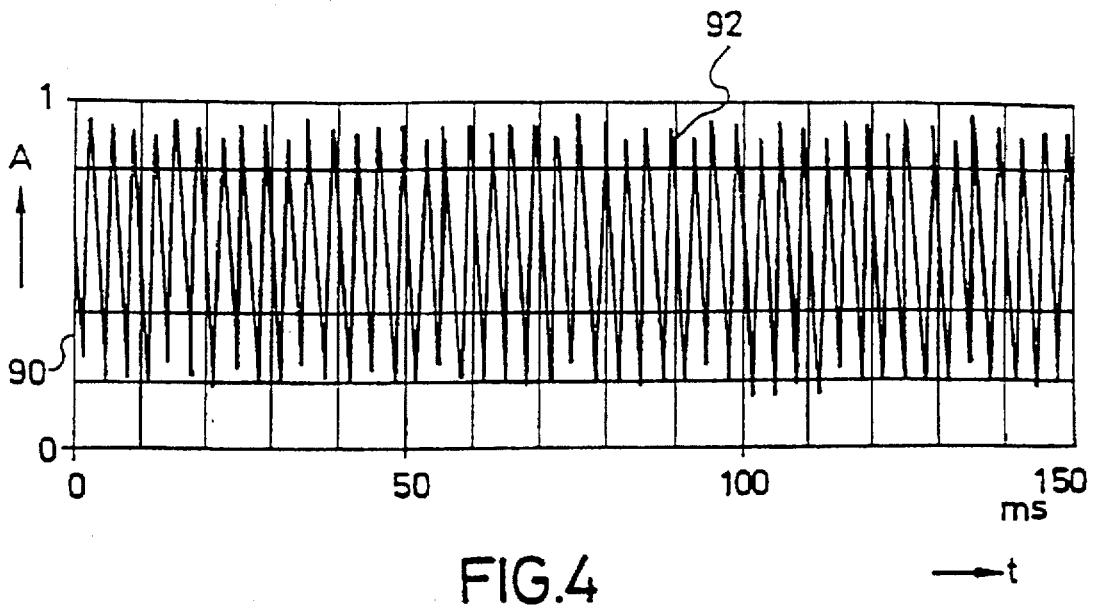
FIG. 4 shows the measured course of the annealing current with regard to time during a test.

FIG. 4 gives the course of time of the current 92 in the annealing section III for a predetermined time interval. A non-dimensional annealing current parameter is entered on ordinate 90 and the time on abscissa 91.

Figure 5:
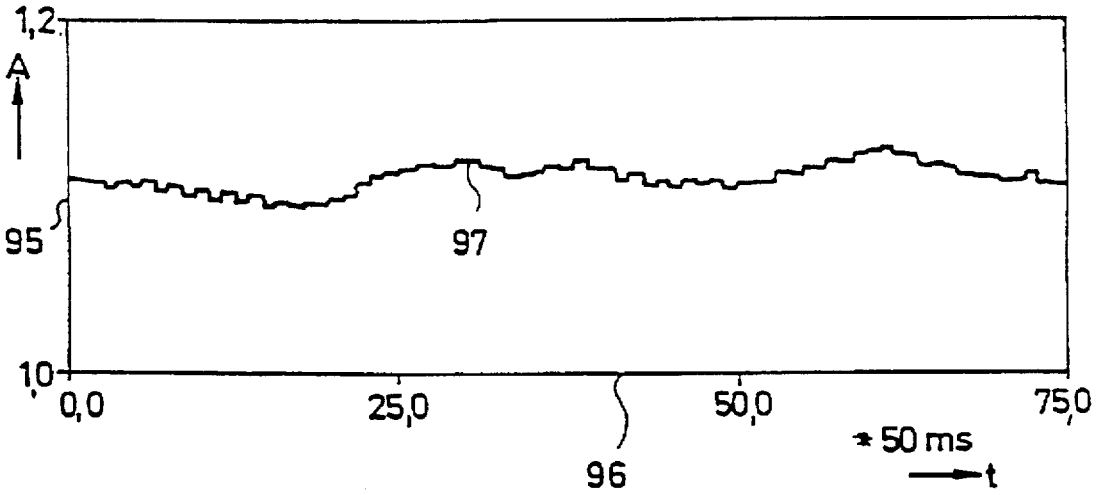
FIG. 5 shows the effective current value derived from the current course in accordance with FIG. 4.

FIG. 5 shows (for a longer time interval than FIG. 4) the effective value 97 of the current, a non-dimensional parameter of the current again being entered on the ordinate 95 and the time on abscissa 96. It is interesting to see that the current is subject to major fluctuations despite constant wire passing speed.

On the basis of the voltage and current values measured for each of the three annealing sections the processor 50 determines the annealing output in the individual annealing sections by multiplying the relevant effective voltage and current values.

Figure 6:
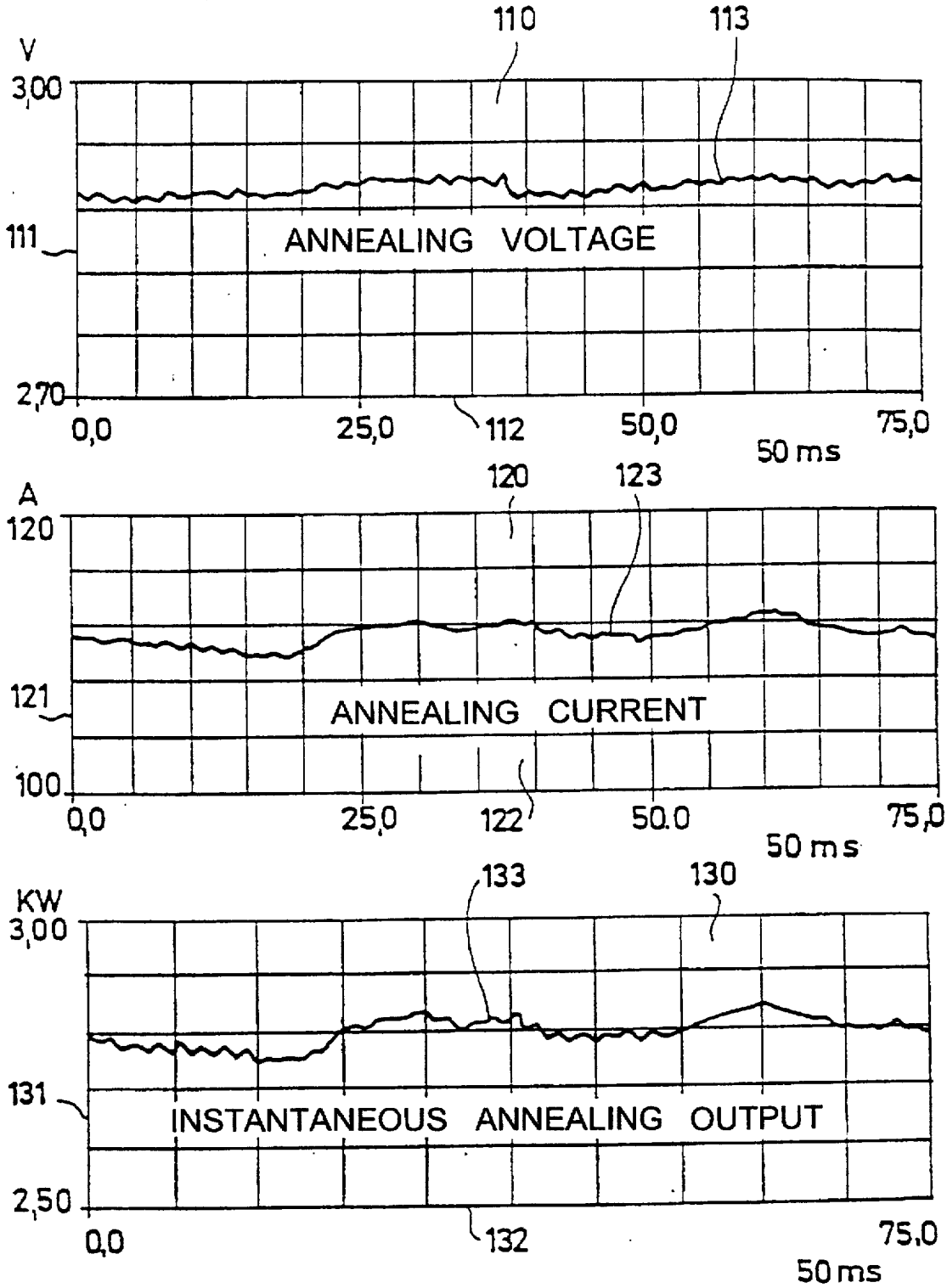
FIG. 6 shows a diagram, giving the voltage value, the current value measured during a test and the output calculated in non-dimensional units with regard to time.

FIG. 6 shows in three diagrams, arranged one upon the other, the annealing voltage, the annealing current and the annealing output in annealing section III. In the uppermost diagram 110 a non-dimensional voltage parameter is entered on ordinate 111 and the time on the time axis 112. The curve 113 gives the non-dimensional voltage parameter.

In diagram 120 a non-dimensional current parameter is indicated on ordinate 121 and the time on abscissa 122, the units are identical to that in diagram 110. Curve 123 reflects the course of a non-dimensional annealing current parameter with regard to time.

In the third diagram 130 a non-dimensional parameter for electric power is entered on ordinate 130 and the time on abscissa 132 in the same units and at the same time as in diagrams 110 and 120. Curve 133 reflects the instantaneous annealing output calculated by processor 50.

For each annealing section I, II and III the processor 50 now compares the instantaneously fed power with the annealing output, required for the relevant speed. This may be done by evaluating the above formula. However, it is also possible to store an adequate performance characteristics for the desired annealing power values in a memory of the control unit 50; the relevant required annealing output for the annealing sections I, II and III will then be determined by the help of this memory, possibly by interpolation.

If there appears a difference between the desired annealing output and the measured annealing outputs, the signal gnerating units 53, 54, 55 will be influenced accordingly in order to change the annealing voltage in the individual annealing sections such that the deviation will be minimized. This guarantees a very rapid and precise regulation of the annealing output, having positive effects on the quality of the wire manufactured.

Apart from this regulation task the processor has to monitor the measured variables to detect an irregular operation of the system, in particular wear On brushes and/or contact rollers.

As the wire resistance in the individual annealing sections is known, it may be determined, whether a major, not desired voltage drop occurs in the current transfer from brush to contact roller and/or from contact roller to wire. If it is detected that the voltage required for generating a certain annealing current is higher than a predetermined limit value, a signal will be emitted to show the malfunction of the annealing plant.

Instead of calculating the voltage drop comparative values may be stored in a table, stating which annealing voltage is required for correct operation, in order to incite a certain annealing current. In case the measured effective voltage values exceed these stored values by a certain amount, this indicates an undesirably high transition resistance.

In addition the processor 50 monitors the time fluctuations of annealing current and annealing output. If the annealing current is subject to major time fluctuations, this is a distinct indication for irregular current transmission. This indicates wear on the contact rollers. The effective value of the annealing current and the annealing output with regard to amplitude fluctuation and with regard to fluctuation frequency will be investigated for assessing the fluctuation. The values of the annealing current and annealing ouput already available in digital form will be subjected to numerical statistical procedures for curve assessment, as is prior art.

The arrangement and the process described above permit a very exact detection and regulation of the annealing output, thus the wire will be heated exactly according to the desired temperature profile. Contrary to prior art arrangements the deviations in annealing output may be detected especially by transition resistances and balanced by regulation.

In the embodiment example given each annealing section I, II and III is regulated individually to the predetermined annealing output value. To simplify the structure it is also possible to regulate only one or only two annealing sections instead of all three annealing sections. If only one annealing section will be regulated, annealing section III will preferably be regulated, if two annealing sections will be regulated, annealing section I and annealing section III will preferably be regulated.

Furthermore it is possible to combine the regulation of annealing section I and II in one regulation.

If at least two annealing sections will be regulated according to the above described process, it is also possible to compensate for a plant standstill and the resulting cooling down of the wire within the annealing arrangement. As described in DE 40 10 309 C1, the annealing power fed to the last annealing section III will be increased during a predetermined period of time to such an extent that the cooling down in the annealing plant will be compensated. At a time interval of 500 μs between the individual scannings and a wire speed of 10 m/s the individual measurement points with relation to the wire have a distance of 5 mm, thus permitting a very exact regulation.

What is claimed is:

1. A process for regulating an annealing power in at least one annealing section of a continuous annealing and processing line for continuously cast metal products, comprising the steps of:

measuring a passing speed of the continuously cast metal products (D) passing through the continuous annealing and processing line and outputting a representative electrical signal by means of a first measuring system (7), measuring an instantaneous voltage value on the annealing section and outputting a representative electrical signal by means of a second measuring system (30, 31, 32), transforming the measured instantaneous voltage value into an effective voltage value ($U_e$), and forming a control signal on the basis of the effective voltage value by means of a control unit (50) for changing a voltage supplied to the annealing section in order to obtain a predetermined annealing power value which is dependent on the speed measured, characterized by the steps of detecting a current flowing in at least one annealing section by means of a third measuring system (40, 41, 42), digitizing and integrating the instantaneous voltage value or values at the annealing section in order to determine the effective voltage value for a respective short period of time each, digitizing and integrating a measured instantaneous value of the annealing current in order to determine the corresponding effective value for the same respective short period of time as in the case of the annealing voltage, and providing the control unit as a processor for multiplying the calculated effective values of the annealing voltage and the annealing current in order to calculate the annealing power actually supplied to the individual annealing section and to compare it with the predetermined annealing power.

2. The process according to claim 1, comprising the step of contactlessly measuring the current flowing in said at least one annealing section on a wire located in the annealing section.

3. The process according to claim 1, comprising the step of measuring the electrical resistance on the basis of the measured effective values of the annealing voltage and of the measured effective values of the annealing current and outputting an alarm signal if this resistance exceeds a predetermined value by means of the processor.

4. The process according to claim 2, comprising the step of measuring the electrical resistance on the basis of the measured effective values of the annealing voltage and of the measured effective values of the annealing current and outputting an alarm signal if this resistance exceeds a predetermined value by means of the processor.

5. An arrangement for regulating an annealing power in at least one annealing section of a continuous annealing and processing line for continuously cast metal products, comprising:

a first measuring equipment (7) for measuring a passing speed of the continuously cast metal product (D) passing through the continuous annealing and processing line and for outputting a representative electrical signal, a second measuring equipment (30, 31, 32) for measuring an instantaneous voltage value on the annealing section and for outputting a representative electrical signal, a first determining equipment for determining an effective voltage value ($U_e$) on the basis of said measured instantaneous voltage value on the annealing section, a control unit (50) for forming a control signal from said determined effective voltage value for changing the voltage supplied to the annealing section in order to obtain a predetermined annealing power value dependent on the speed measured, a third measuring equipment (40, 41, 42) for emitting a measuring signal representative of annealing current flowing in said at least one annealing section, and a second determining equipment for determining an effective current value on the basis of said measured instantaneous current value, said first and second determining equipment including a first (35, 36, 37) and a second (45, 46, 47) transforming equipment having a digitizing unit for digitizing the measured instantaneous values of voltage and current, and each transforming equipment is followed by an integrating equipment for determining the corresponding effective value from this digitized value for a predetermined short period of time, and the control unit is designed as a processor and includes a multiplication equipment for calculating the annealing power actually supplied to the respective annealing section from said calculated effective values.

6. The arrangement according to claim 5, characterized in that the third measuring equipment (40, 41, 42) is provided as a induction measuring instrument for contactlessly detecting the current flowing through the annealing section.

7. The arrangement according to claim 5, characterized in that the first and second equipment are designed such that the distance of time, in which the individual measured values are taken and digitized, is less than 5 ms.

8. The arrangement according to claim 5, characterized in that the first and second equipment are designed such that the distance of time, in which the individual measured values are taken and digitized, is less than 1 ms.

9. The arrangement according to claim 6, characterized in that the third measuring equipment (40, 41, 42) is designed as an iron ring (70) interrupted by a gap (71) and a Hall-probe (73) is arranged in the gap for measuring the magnetic flux in the iron ring.

10. The arrangement according to claim 6, characterized in that each transforming unit (35, 36, 37, 45, 46, 47) includes a low-pass filter followed by an analog to digital converter.

11. The arrangement according to claim 6, characterized in that the first and second equipment are designed such that the distance of time, in which the individual measured values are taken and digitized, is less than 5 ms.

12. The arrangement according to claim 6, characterized in that the first and second equipment are designed such that the distance of time, in which the individual measured values are taken and digitized, is less than 1 ms.

13. The arrangement according to claim 9, characterized in that the iron ring is designed as a divisible ring in order to facilitate inserting of a wire.

14. The arrangement according to claim 9, characterized in that each transforming unit (35, 36, 37, 45, 46, 47) includes a low-pass filter followed by an analog to digital converter.

15. The arrangement according to claim 9, characterized in that the first and second equipment are designed such that the distance of time, in which the individual measured values are taken and digitized, is less than 5 ms.

16. The arrangement according to claim 9, characterized in that the first and second equipment are designed such that the distance of time, in which the individual measured values are taken and digitized, is less than 1 ms.

17. The arrangement according to claim 13, characterized in that each transforming unit (35, 36, 37, 45, 46, 47) includes a low-pass filter followed by an analog to digital converter.

18. The arrangement according to claim 13, characterized in that each transforming unit (35, 36, 37, 45, 46, 47) includes a low-pass filter followed by an analog to digital converter.

19. The arrangement according to claim 13, characterized in that the first and second equipment are designed such that the distance of time, in which the individual measured values are taken and digitized, is less than 5 ms.

20. The arrangement according to claim 13, characterized in that the first and second equipment are designed such that the distance of time, in which the individual measured values are taken and digitized, is less than 1 ms.

21. The arrangement according to claim 17, characterized in that the first and second equipment are designed such that the distance of time, in which the individual measured values are taken and digitized, is less than 5 ms.

22. The arrangement according to claim 17, characterized in that the first and second equipment are designed such that the distance of time, in which the individual measured values are taken and digitized, is less than 1 ms.

* * * * *

UNITED STATES PATENT AND TRADEMARK OFFICE

CERTIFICATE OF CORRECTION

PATENT NO. : 5,700,335

DATED : December 23, 1997

INVENTOR(S) : Gunther Phillip

It is certified that error appears in the above-identified patent and that said Letters Patent is hereby corrected as shown below:

[Item 57] Abstract, line 7, "($U_c$)" should be --($U_e$)--.

Col. 4, line 52, "500 82 s," should be --500 μs,--.

Col. 6, line 41, "On" should be --on--.

Signed and Sealed this

Sixteenth Day of June, 1998

*Attest:*

*Attesting Officer*

BRUCE LEHMAN

*Commissioner of Patents and Trademarks*